US005535848A

United States Patent [19]

Giuliano et al.

[11] Patent Number: 5,535,848

[45] Date of Patent: Jul. 16, 1996

[54] ESCAPE CHUTE

[76] Inventors: Paul S. Giuliano, 4201 Topanga Cyn Blvd. #198, Woodland Hills, Calif. 91364; Rudolfo Sanchez, P.O. Box 1703, Arboles, Colo. 81121

[21] Appl. No.: 289,431

[22] Filed: Aug. 12, 1994

[51] Int. Cl.[6] ..... A62B 1/20

[52] U.S. Cl. ..... 182/49; 182/113

[58] Field of Search ..... 182/48, 49, 113, 182/129

[56] References Cited

U.S. PATENT DOCUMENTS 4,498,557 2/1985 Horne ..... 187/49

4,606,431 8/1986 Ruder ..... 182/49

4,773,505 9/1988 Chiba ..... 182/49

4,939,876 7/1990 Berner ..... 182/113 X

*Primary Examiner*—Alvin C. Chin-Shue

*Attorney, Agent, or Firm*—Michael I. Kroll

[57] ABSTRACT

An escape chute for a stairwell against a wall within a high-rise building comprising a slide assembly. A structure is for pivotally mounting the slide assembly in an angular condition to the wall above the stairwell. The slide assembly can go from a stored position against the wall to an extended position over the stairwell. This allows people a safe and rapid exit from the high-rise building during an emergency situation when an elevator in the high-rise building is not to be used.

4 Claims, 3 Drawing Sheets

ESCAPE CHUTE

BACKGROUND OF THE INVENTION

1. Field of the Invention

The instant invention relates generally to emergency evacuation equipment and more specifically it relates to an escape chute.

2. Description of the Prior Art

Numerous emergency evacuations equipment have been provided in prior art that are adapted to remove people from buildings during dangerous situations, such as a fire, bomb scare, etc. While these units may be suitable for the particular purpose to which they address, they would not be as suitable for the purposes of the present invention as heretofore described.

SUMMARY OF THE INVENTION

A primary object of the present invention is to provide an escape chute that will overcome the shortcomings of the prior art devices.

Another object is to provide an escape chute that is hinged to a wall of a stairwell, to allow people a safe and rapid exit from a high-rise building during an emergency situation, when an elevator is not to be used.

An additional object is to provide an escape chute that contains spring counter balance support arms and integral handrails, to control the rate of decent and safety for the people exiting the high-rise building on a slide bed.

A further object is to provide an escape chute that is simple and easy to use.

A still further object is to provide an escape chute that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 9 is a front view taken in the direction of arrow 9 in FIG. 1.

DETAILED DESCRIPTION OF THE PREFERRED EMBODIMENTS

Figure 2:
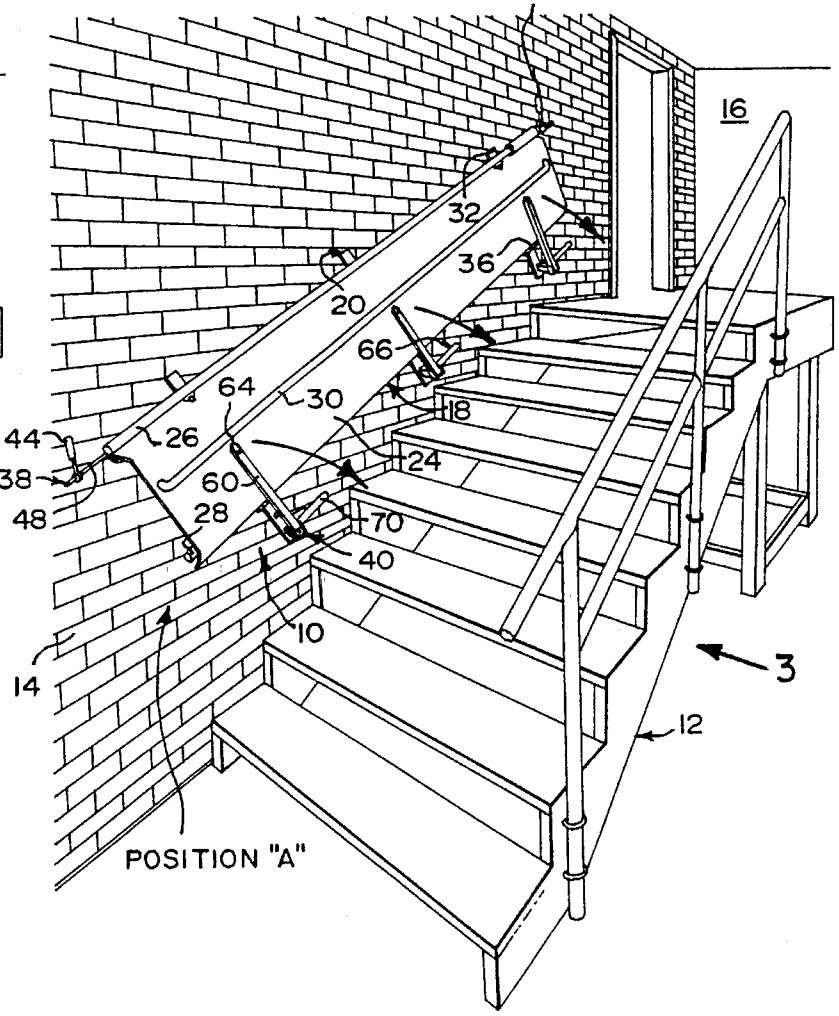
FIG. 2 is a side perspective view similar to FIG. 1, with the instant invention in an up position in a stored condition.
Figure 1:
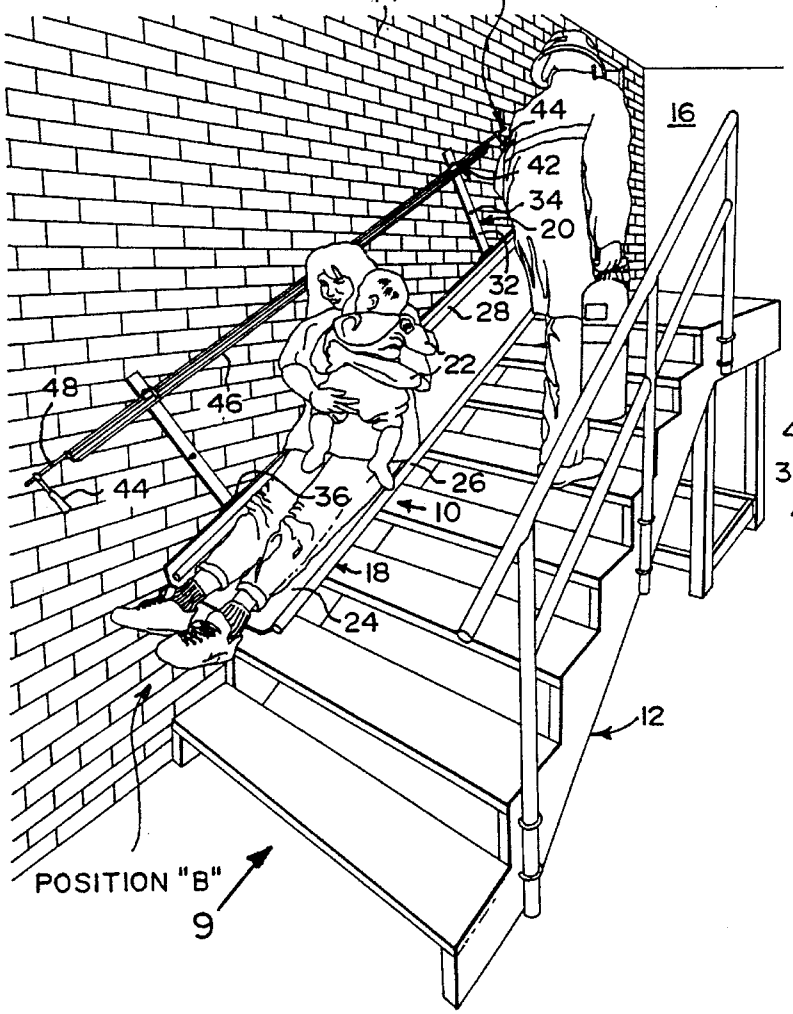
FIG. 1 is a side perspective view showing the instant invention in a down position, in use in a stairwell.

Turning now descriptively to the drawings, in which similar reference characters denote similar elements throughout the several views, FIGS. 1 through 9 illustrate an escape chute 10 for a stairwell 12 against a wall 14 within a high-rise building 16, comprising a slide assembly 18. A structure 20 is for pivotally mounting the slide assembly 18 in an angular condition to the wall 14 above the stairwell 12. The slide assembly 18 can go from a stored position "A" against the wall 14 to an extended position "B" over the stairwell 12. This allows people 22 a safe and rapid exit from the high-rise building 16 during an emergency situation when an elevator in the high-rise building 16 is not to be used.

The slide assembly 18 includes a slide bed 24. A first handrail 26 is on an outer edge of the slide bed 24. A second handrail 28 is on an inner edge of the slide bed 24, to control the rate of decent of the people 22 on the slide bed 24. A third handrail 30 is on a bottom surface of the slide bed 24, which will act as an auxiliary railing for the stairwell 12, when the slide assembly 18 is in the stored position "A" against the wall 14.

The pivotal mounting structure 20 consists of a plurality of mounting bars 32. A plurality of fasteners 34 are for securing the mounting bars 32 in spaced apart relationships to the wall 14 above the stairwell 12. A plurality of hinges 36 are also provided. Each hinge 36 is for pivotally securing the inner edge of the slide bed 24 to each mounting bar 32 near a bottom end thereof.

A device 38 is for releasably retaining the slide assembly 18 in the stored position "A" against the wall 14. An apparatus 40 is for supporting the slide assembly 18 in the extended position "B" over the stairwell 12.

The releasable retaining device 38 includes a pair of latch mechanism 42, mounted near a top end of the uppermost mounting bar 32 and the lowermost mounting bar 32, for holding the slide bed 24 of the slide assembly 18 in the stored position "A" against the wall 14. A pair of release handles 44 are coupled between the latch mechanism 42 at the uppermost mounting bar 32 and the lowermost mounting bar 32. Each release handle 44 when operated can engage and disengage the latch mechanisms 42 from the slide bed 24 near the outer edge thereof.

An elongated L-shaped channel bracket 46 is transversely affixed to the mounting bars 32 near the top end thereof, for maintaining the latch mechanisms 42 to the respective mounting bars 32. An elongated shaft 48 extends through the latch mechanism 42 in a rotatable manner with the release handles 44 connected to opposite ends of the shaft 48.

Figure 4:
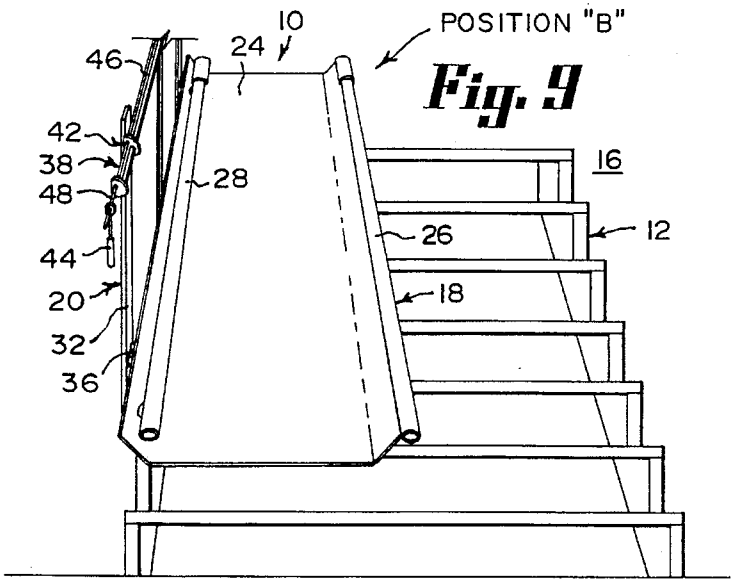
FIG. 4 is a cross sectional view taken along line 4—4 in FIG. 3, showing the latch mechanism opened.
Figures 4, 5, 6:
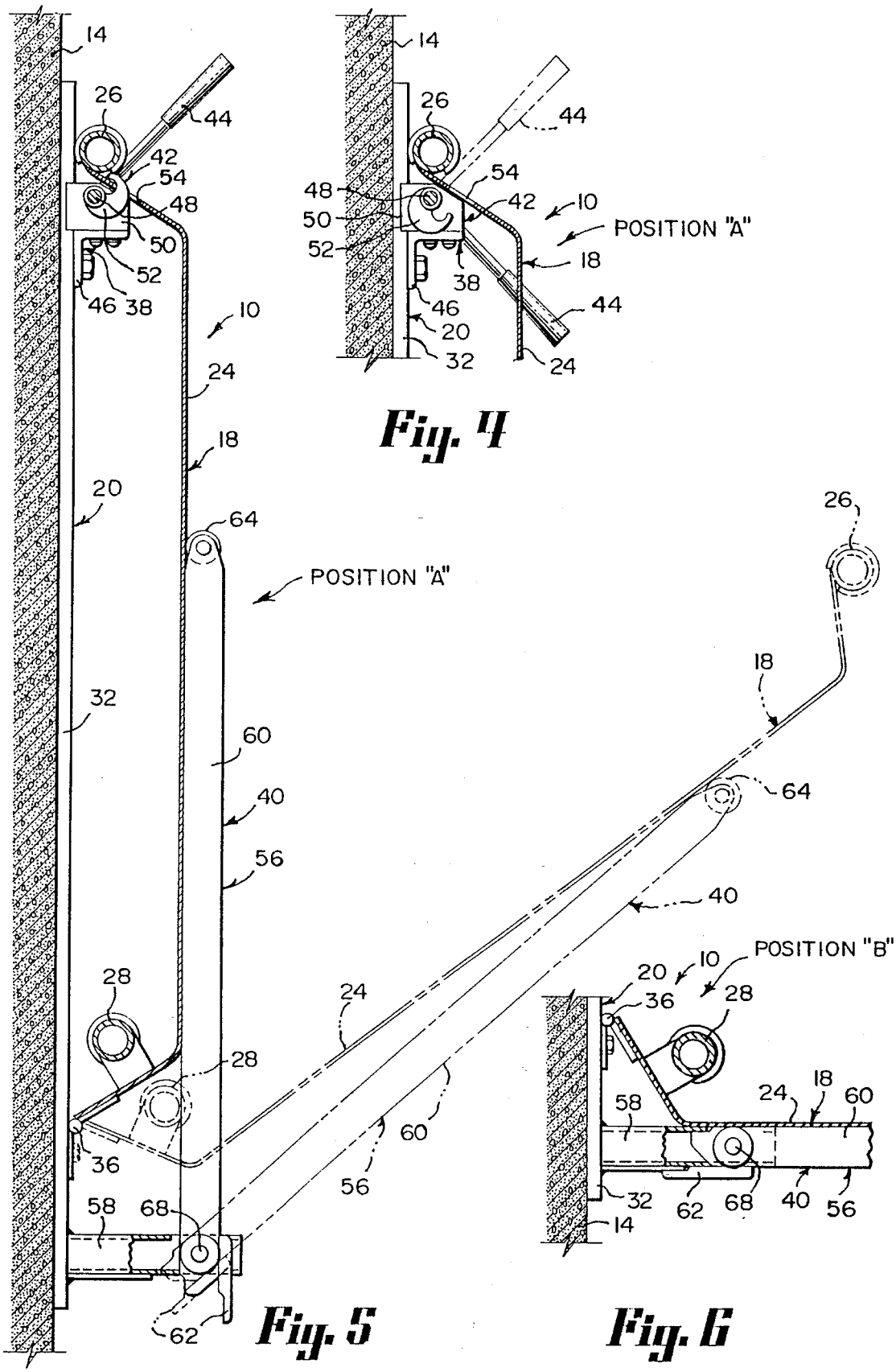
FIG. 5 is a cross sectional view taken along line 5—5 in FIG. 3, showing the latch mechanism closed and the slide assembly partly opened in phantom lines.
FIG. 6 is a cross sectional view taken along line 6—6 in FIG. 3, showing a portion of the slide assembly completely opened.

Each latch mechanism 42, as best seen in FIGS. 4 and 5, contains a housing 50 on the L-shaped channel bracket 46 at one mounting bar 32 with the shaft 48 going through the housing 50. A hook member 52 is affixed to the shaft 48 adjacent the housing 50. The slide bed 24 has an aperture 54 adjacent the outer edge near the hook member 52. When either of the release handles 44 are operated, the hook member 52 on each latch mechanism 42 will engage and disengage with the respective aperture 54 in the slide bed 24.

The supporting apparatus 40, as best seen in FIGS. 5 through 8, is a plurality of support arm units 56 with each one pivotally attached to each mounting bar 32 below the respective hinge 36 of the slide bed 24. Each support arm unit 56 includes a foot bracket 58 extending from the respective mounting bar 32 at the bottom end thereof. A support arm 60 has a stop portion 62, pivotally connected to a distal end of the foot bracket 5. The support arm 60 can extend outwardly in an aligned arrangement with the foot bracket 58, when the slide assembly 18 is in the extended position "B". A roller 64 is on a distal free end of the support arm 60, to engage with the underside of the slide bed 24 of the slide assembly 18. A facility 66 is for applying an adjustable torque to the pivotal connection of the support arm 56 to the foot bracket 58, so that the support arm 56 can withstand a weight applied to the slide bed 24.

Figure 8:
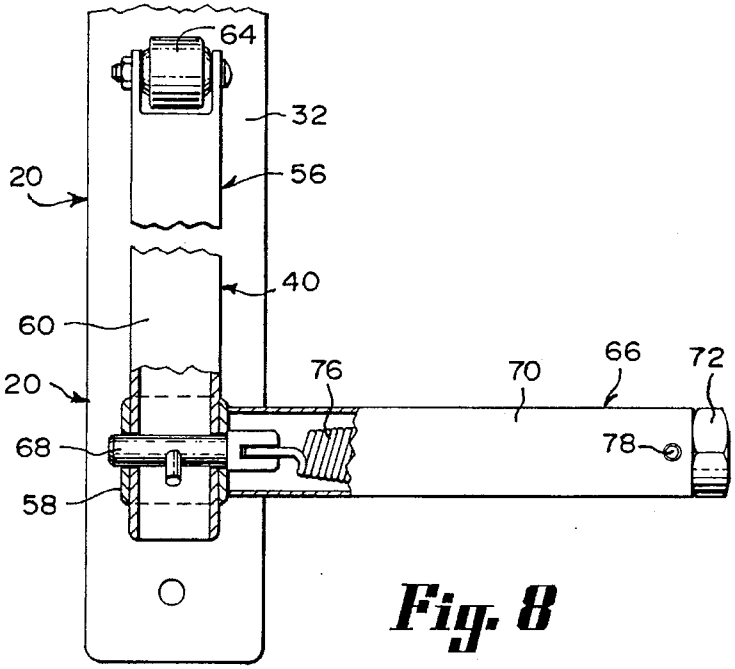
FIG. 8 is an elevational view taken along line 8—8 in FIG. 7.
Figure 7:
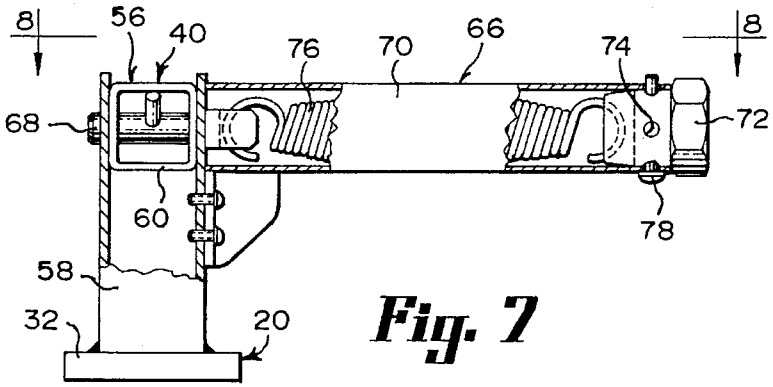
FIG. 7 is a bottom view taken along line 7—7 in FIG. 3, with parts broken out and in section of one support arm assembly in greater detail.
Figure 3:
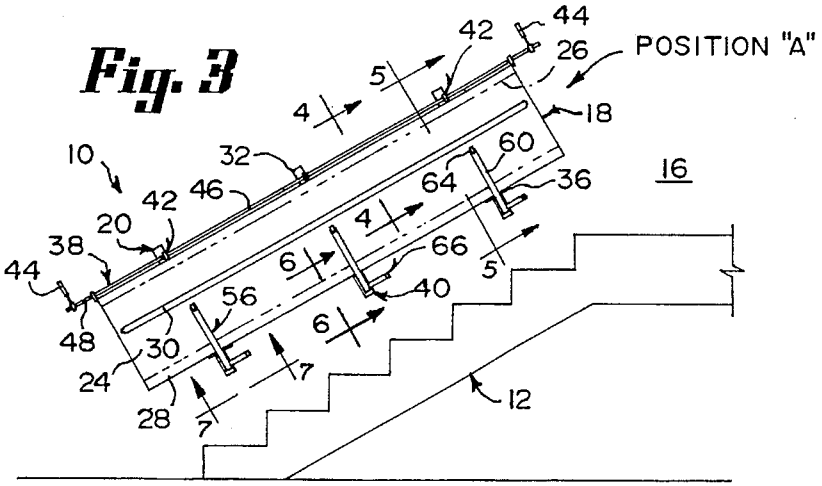
FIG. 3 is a diagrammatic side view taken in the direction of arrow 3 in FIG. 2.

The adjustable torque applying facility 66, as best seen in FIGS. 7 and 8, includes a torque pin 68 between the support arm 60 and the foot bracket. A sleeve 70 is affixed to and extends from one side of the foot bracket 58 in an alignment with the torque pin 68. An adjustable torque bolt 72 is on a free end of the sleeve 70. The bolt 72 has a plurality of transverse radial bores 74 therethrough. A recoil spring 76 is within the sleeve 70 between the torque pin 68 and the adjustable torque bolt 72. A removable pin 78 extends through the sleeve 70 at the free end and into one bore 74 in the adjustable torque bolt 72. The pin 78 holds the adjustable torque bolt 72 in place with the recoil spring 76 applying pressure to the torque pin 68 to counterbalance the support arm 60.

LIST OF REFERENCE NUMBERS

A stored position
B extended position
10 escape chute
12 stairwell
14 wall
16 high-rise building
18 slide assembly
20 pivotal mounting structure
22 people
24 slide bed
26 first handrail on 24
28 second handrail on 24
30 third handrail on 24
32 mounting bar
34 fastener
36 hinge for 24 and 32
38 releasable retaining device
40 supporting apparatus
42 latch mechanism
44 release handle
46 elongated L-shaped channel bracket
48 elongated shaft
50 housing
52 hook member
54 aperture in 24
56 support arm unit
58 foot bracket
60 support arm
62 stop portion on 60
64 roller on 60
66 adjustable torque applying facility
68 torque pin
70 sleeve
72 adjustable torque bolt
74 transverse radial bore
76 recoil spring
78 removable pin It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An escape chute for a stairwell against a wall within a high-rise building comprising:

a) a slide assembly, said slide assembly including a slide bed, a first handrail on an outer edge of said slide bed, a second handrail on an inner edge of said slide bed to control the rate of decent of the people on said slide bed, and a third handrail on a bottom surface of said slide bed, which will act as an auxiliary railing for the stairwell, when said slide assembly is in the stored position against the wall;

b) means for pivotally mounting said slide assembly in an angular condition to the wall above the stairwell, so that said slide assembly can go from a stored position against the wall to an extended position over the stairwell, to allow people a safe and rapid exit from the high-rise building during an emergency situation when an elevator in the high-rise building is not to be used, said pivotal mounting means including a plurality of mounting bars, a plurality of fasteners for securing said mounting bars in spaced apart relationships to the wall above the stairwell, and a plurality of hinges, each for pivotally securing the inner edge of said slide bed to each said mounting bar near a bottom end thereof;

c) means for releasably retaining said slide assembly in the stored position against the wall, said releasable retaining means including a pair of latch mechanisms mounted near a top end of the uppermost mounting bar and the lowermost mounting bar, for holding said slide bed of said slide assembly in the stored position against the wall, and a pair of release handles coupled between said latch mechanism at said uppermost mounting bar and said lowermost mounting bar, wherein each said release handle when operated can engage and disengage said latch mechanisms from said slide bed near the outer edge thereof;

d) means for supporting said slide assembly in the extended position over the stairwell;

e) an elongated L-shaped channel bracket transversely affixed to said mounting bars near the top end thereof, for maintaining said latch mechanisms to said respective mounting bars; and f) an elongated shaft extending through said latch mechanism in a rotatable manner with said release handles connected to opposite ends of said shaft, each said latch mechanism including a housing on said L-shaped channel bracket at one said mounting bar with said shaft going through said housing, a hook member affixed to said shaft adjacent said housing, and said slide bed having an aperture adjacent the outer edge near said hook member, so that when either of said release handles are operated, said hook member on each latch mechanism will engage and disengage with said respective aperture in said slide bed.

2. An escape chute as recited in claim 1, wherein said supporting means includes a plurality of support arm units, each one pivotally attached to each said mounting bar below said respective hinge of said slide bed.

3. An escape chute as recited in claim 2, wherein each said support arm unit includes:

a) a foot bracket extending from said respective mounting bar at the bottom end thereof;

b) a support arm having a stop portion pivotally connected to a distal end of said foot bracket, so that said support arm can extend outwardly in an aligned arrangement with said foot bracket, when said slide assembly is in the extended position;

c) a roller on a distal free end of said support arm to engage with the underside of said slide bed of said slide assembly; and d) means for applying an adjustable torque to pivotal connection of said support arm to said foot bracket, so that said support arm can withstand a weight applied to said slide bed.

4. An escape chute as recited in claim 3, wherein said adjustable torque applying means includes:

a) a torque pin between said support arm and said foot bracket;

b) a sleeve affixed to and extending from one side of said foot bracket in an alignment with said torque pin;

c) an adjustable torque bolt on a free end of said sleeve, said bolt having a plurality of transverse radial bores therethrough;

d) a recoil spring within said sleeve between said torque pin and said adjustable torque bolt; and e) a removable pin to extend through said sleeve at the free end and into one said bore in said adjustable torque bolt, so as to hold said adjustable torque bolt in place with said recoil spring applying pressure to said torque pin to counterbalance said support arm.

* * * * *